US005086600A

United States Patent [19]

Holland et al.

[11] Patent Number: 5,086,600

[45] Date of Patent: Feb. 11, 1992

[54] BLOCK FOR CONCRETE WALL FORM CONSTRUCTION

[75] Inventors: Geary C. Holland; Charles E. Allison, both of St. Petersburg, Fla.

[73] Assignee: Revelation Builders, Inc., St. Petersburg, Fla.

[21] Appl. No.: 514,734

[22] Filed: Apr. 26, 1990

[51] Int. Cl.[5] ..... E04C 3/22

[52] U.S. Cl. ..... 52/594; 52/591; 52/309.12; 52/426; 52/564

[58] Field of Search ..... 52/591, 593, 594, 309.12, 52/564, 426, 427, 428

[56] References Cited

U.S. PATENT DOCUMENTS

| | | | |
|---|---|---|---|
| 1,572,887 | 2/1976 | Dale | 138/100 X |
| 4,439,967 | 4/1984 | Prelenberg | 52/593 X |
| 4,516,364 | 5/1985 | Heider | 52/593 X |
| 4,706,429 | 11/1987 | Young | 52/564 X |
| 4,884,322 | 12/1989 | Horobin | 52/564 X |
| 4,889,310 | 12/1989 | Boeshart | 52/564 X |
| 4,894,969 | 1/1990 | Horobin | 52/564 X |

FOREIGN PATENT DOCUMENTS

| | | | |
|---|---|---|---|
| 256279 | 5/1963 | Australia | 52/591 |
| 2351632 | 4/1975 | Fed. Rep. of Germany | 52/591 |
| 2618125 | 4/1977 | Fed. Rep. of Germany | 52/593 |

*Primary Examiner*—Richard E. Chilcot, Jr.
*Assistant Examiner*—Kien Nguyen
*Attorney, Agent, or Firm*—Zarley, McKee, Thomte, Voorhees, & Sease

[57] ABSTRACT

This invention provides a block to be used with the block means of similar character to create a form for a concrete wall. The blocks are of lightweight plastic and are of substantially rectangular shape, and have opposite ends, opposite sides, upper and lower interlocking surfaces, a substantially hollow interior compartment, and opposite end walls and opposite side walls. The upper interlocking surfaces comprise an elongated longitudinal rib having a rectangular base and an inverted V-shaped upper surface. These ribs have a width less than that of the side walls, and have a substantially horizontal ledge adjacent either side thereof. Lateral extending ribs spaced from each other extend across the ledges and ribs. The lateral extending ribs also have an inverted V-shaped upper surface which extends from a lower rectangular base portion. A plurlaity of cylindrical plugs extend upwardly in spaced relation from the ribs. The lower interlocking surface is a mere image of the upper interlocking surface. Spanner ribs with a U-shaped notch in the upper portion thereof extend through the interior compartment of the block. The notches are adapted to receive an elongated reinforcing rod. The ends of the blocks have U-shaped openings into which a U-shaped plug can be inserted in locked condition to dam off the end of the block which appears at the end of the concrete wall to be poured.

12 Claims, 3 Drawing Sheets

BLOCK FOR CONCRETE WALL FORM CONSTRUCTION

BACKGROUND OF THE INVENTION

Hollow plastic blocks with interlocking upper and lower surfaces have been used in the past for assembly into a wall structure to serve as a form for plastic concrete. The blocks serve essentially as the form for the concrete and provide no structural strength to the structure after the concrete has set. The blocks thereafter do provide permanent insulation, sound attenuation, and further facilitate the installation of electric, gas and water conduits.

Existing blocks used for the foregoing purposes often cannot maintain the poured concrete wall in straight condition, or cannot permit the pouring of a wall of any substantial height. This was because the interlocking surfaces of the blocks are inadequate to maintain the great weight of the plastic concrete. The assembled plastic form blocks often move to a condition of disalignment, and sometimes fail altogether before the concrete has set.

Therefore, the principal object of this invention is to provide a block for concrete wall form construction which will permit substantial interlocking surfaces with adjacent blocks to permit the forming for concrete walls of substantial length and height, and which will maintain the proper alignment thereof.

A further object of this invention is to provide a block for concrete wall form construction which has an increased interlocking surface to strengthen the assemblage with like blocks to create a form for a poured concrete wall.

A still further object of this invention is to provide a block for concrete wall form construction which will easily accommodate elongated lengths of reinforcing steel.

A still further object of this invention is to provide a block for concrete wall form construction which has indices means on the outside surface thereof to permit the insertion of utility lines and boxes.

These and other objects will be apparent to those skilled in the art.

BRIEF SUMMARY OF THE INVENTION

This invention provides a block to be used with the block means of similar character to create a form for a concrete wall. The blocks are of lightweight plastic and are of substantially rectangular shape, and have opposite ends, opposite sides, upper and lower interlocking surfaces, a substantially hollow interior compartment, and opposite end walls and opposite side walls. The upper interlocking surfaces comprise an elongated longitudinal rib having a rectangular base and an inverted V-shaped upper surface. These ribs have a width less than that of the side walls, and have a substantially horizontal ledge adjacent either side thereof. Lateral extending ribs spaced from each other extend across the ledges and ribs. The laterally extending ribs also have an inverted V-shaped upper surface which extends from a lower rectangular base portion. A plurality of cylindrical plugs extend upwardly in spaced relation from the ribs. The lower interlocking surface is a mirror image of the upper interlocking surface.

Spanner ribs with a U-shaped notch in the upper portion thereof extend through the interior compartment of the block. The notches are adapted to receive an elongated reinforcing rod.

The ends of the blocks have U-shaped openings into which a U-shaped plug can be inserted in locked condition to dam off the end of the block which appears at the end of the concrete wall to be poured.

DESCRIPTION OF THE PREFERRED EMBODIMENT

Figure 1:
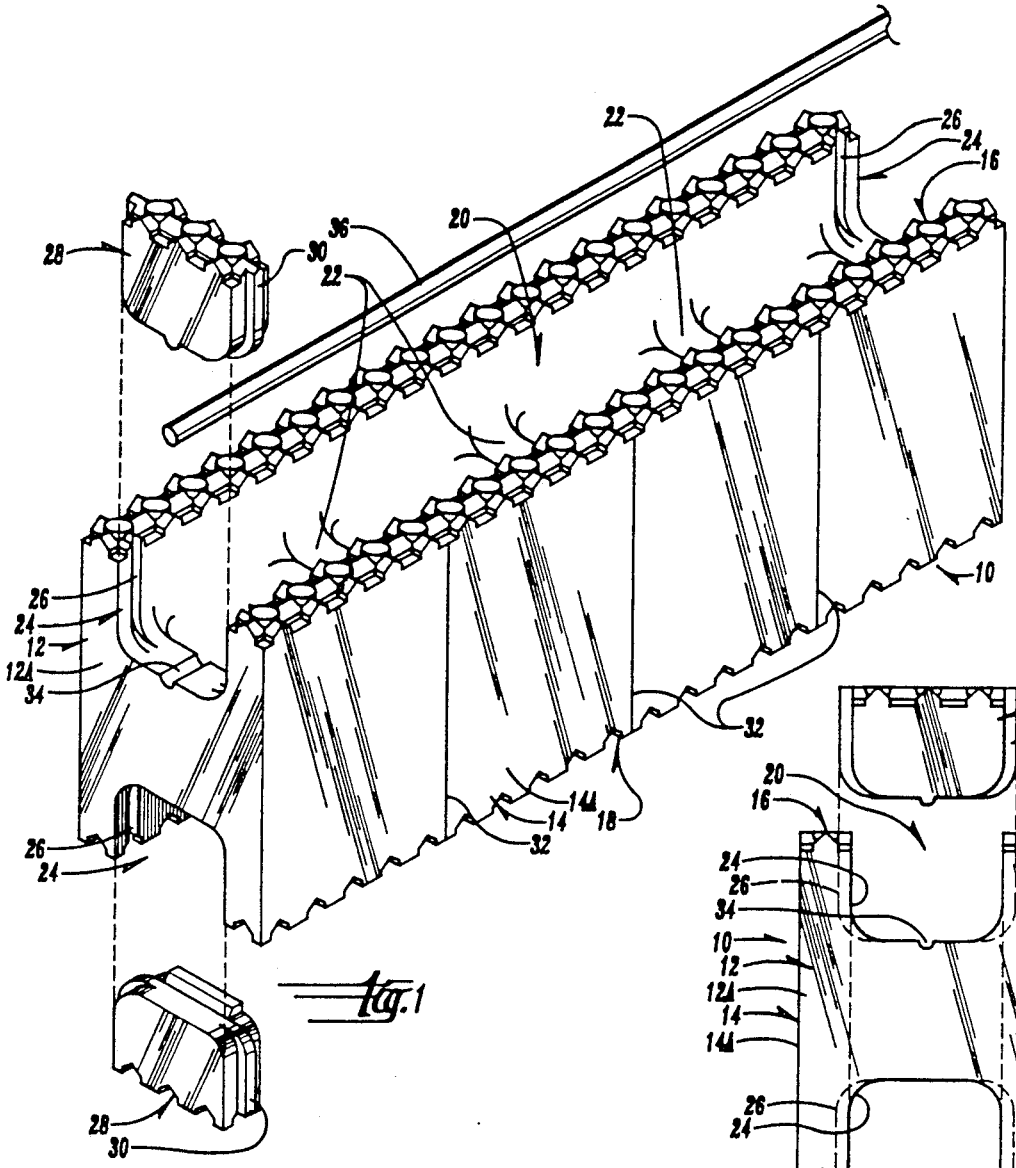
FIG. 1 is an exploded perspective view of the block of this invention showing a reinforcing rod and the plugs which can be inserted into the U-shaped openings at the end of a block which appears at the end of the concrete form.
Figure 2:
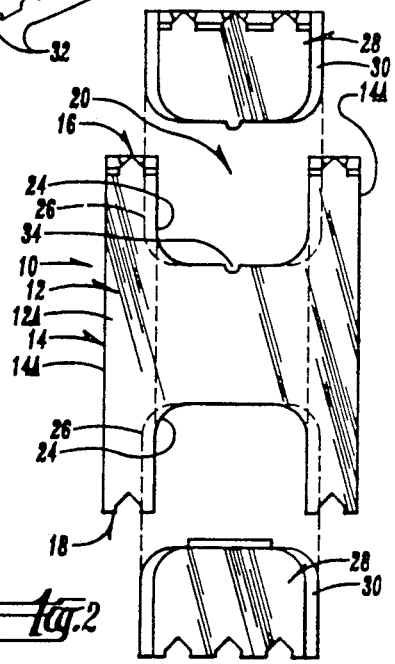
FIG. 2 is an exploded view of the left-hand end of FIG. 1 at a smaller scale.
Figure 3:
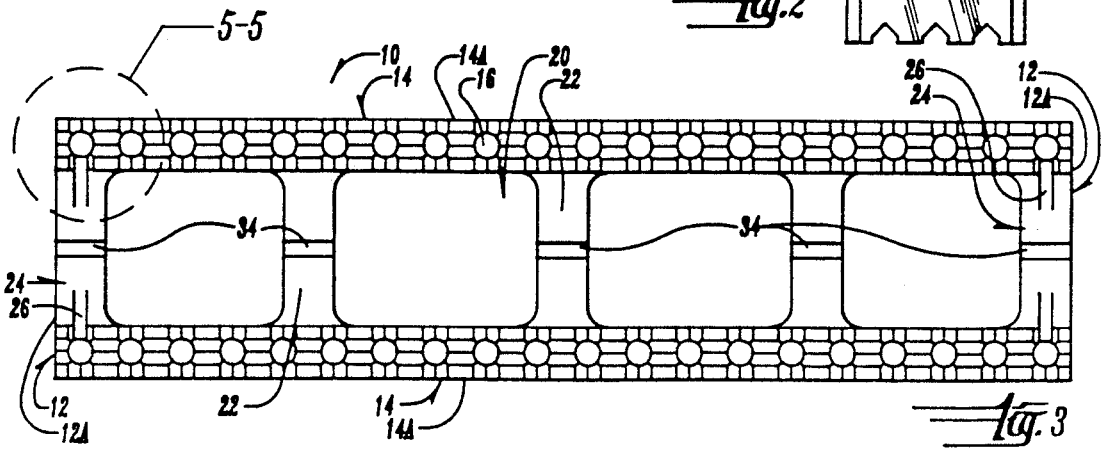
FIG. 3 is a top plan view at a reduced scale of the device of FIG. 1.
Figure 4:
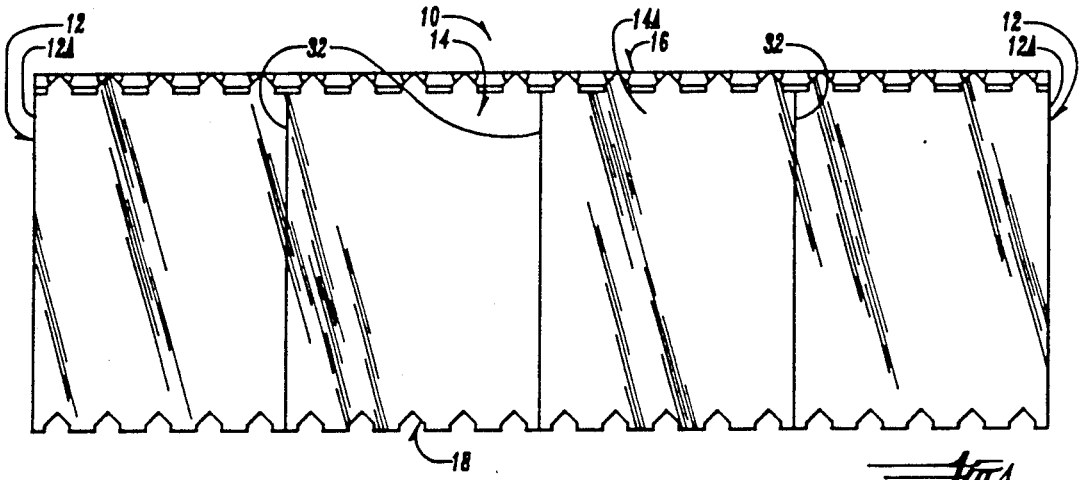
FIG. 4 is a side elevational view of the block of FIG. 3.
Figure 5:
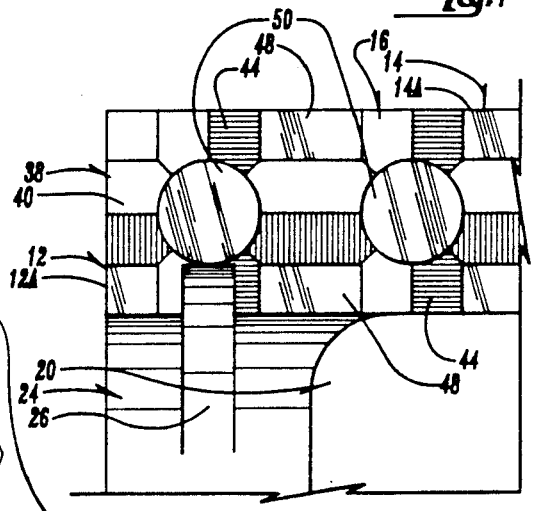
FIG. 5 is a partial plan view taken on line 5—5 of FIG. 3.

Block 10 is comprised of a lightweight plastic material, preferably of flameproof construction. A typical material is E. P. S. Modified Bead, F-Grade, F-554 produced by Huntsman Chemical, Rome, Ga. Block 10 has ends 12 and end walls 12A; sides 14 and side walls 14A; upper and lower interlocking surfaces 16 and 18, respectively; and a hollow interior compartment 20. Spanner ribs 22 extend across the hollow interior compartment 20 and join side walls 14A. The spanner ribs have a height less than that of the side walls.

A U-shaped opening appears in each of the end walls 12A. A lock grove 26 extends around the periphery of the U-shaped openings 24. A U-shaped plug 28 with a locking flange 30 adapted to be inserted into the lock groves 26 are adapted to close the U-shaped openings 24 when it is desired to dam off the interior compartment 20. U-shaped plugs 28 are normally used at the end of the concrete form to be constructed.

Shallow score lines 32 are formed in the outer sides 14 of block 10 directly opposite the ends of the spanner ribs 22. The score lines 32 merely locate the position of the spanner ribs to permit electrical boxes, and various utility lines and connections to be placed in suitable cutout portions of the block and the spanner ribs 22.

Notches 34 are formed in the upper portions of the spanner ribs 22 and the end walls 12A to receive and position elongated reinforcing rods 36.

Figure 8:
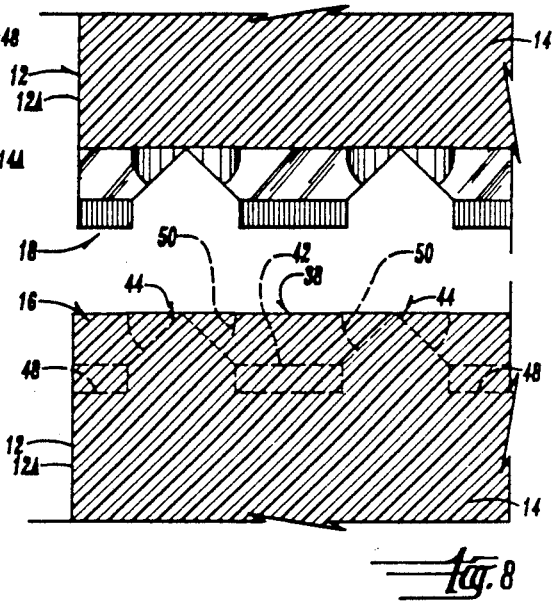
FIG. 8 is a sectional view taken on line 8—8 of FIG. 6.

The upper interlocking surface 16 comprises an elongated rib 38 which extends along the top of each of the side walls 14A. The upper portion of rib 38 is comprised of an inverted V-shaped surface 40 which is above a rectangular shaped base 42. Transverse ribs 44 are spaced apart and extend across ribs 38. The transverse ribs 44 also emerge from a rectangular base 42. The transverse ribs 44 also intersect ledges 48 which are substantially horizontal and extend along the lateral sides of ribs 38. Cylindrical plugs 50 emerge from the intersection of ribs 38 and transverse ribs 44, and extend a slight distance above the ribs as best shown in FIG. 8.

Figure 6:
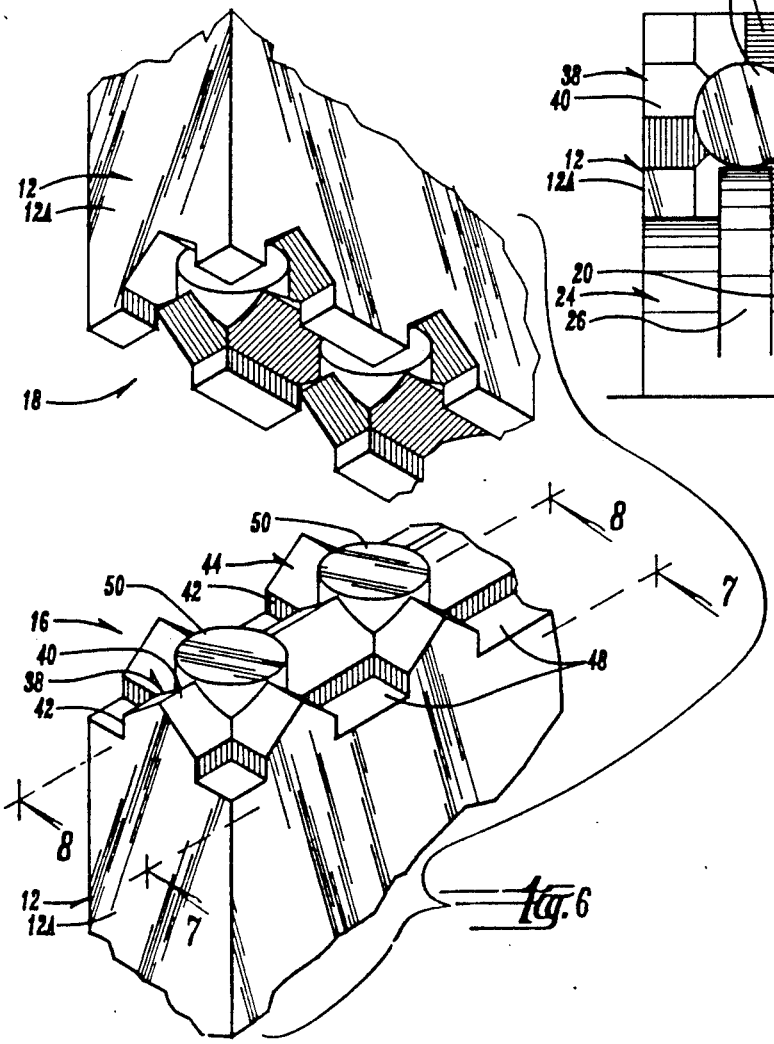
FIG. 6 is a partial perspective view of the upper and lower interlocking surfaces of the block.
Figure 7:
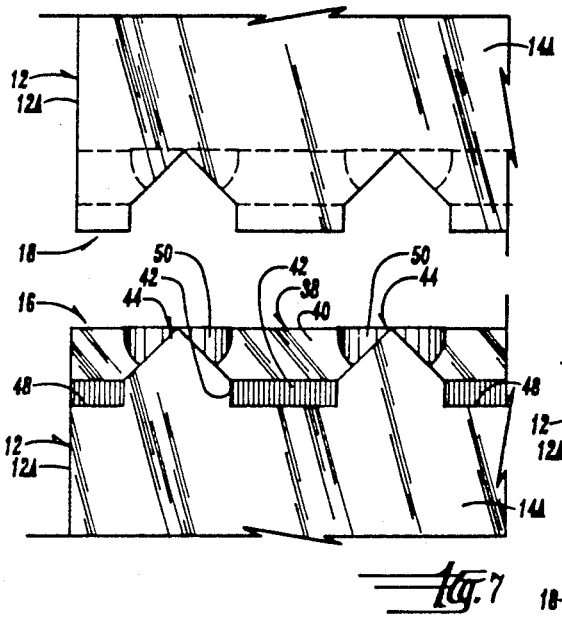
FIG. 7 is a partial elevational view taken on line 7—7 of FIG. 6.

As seen in FIG. 6, the lower interlocking surface is a mirror image of the upper interlocking surface 16. Further, the symmetry of the upper and lower interlocking surfaces 16 and 18 permit various of the blocks 10 to be stacked in overlapping position so that any of the transverse ribs 44 and cylindrical plugs 50 can be received in the corresponding mirror image portions of any lower interlocking surface.

It should be noted that the upper end plug 28 in FIG. 1 has an interlocking surface similar to the configuration of upper interlocking surface 16. The interlocking surface appearing at the bottom plug 28 in FIG. 1 has a mirror image of the interlocking surface of the upper plug 28.

Figure 9:
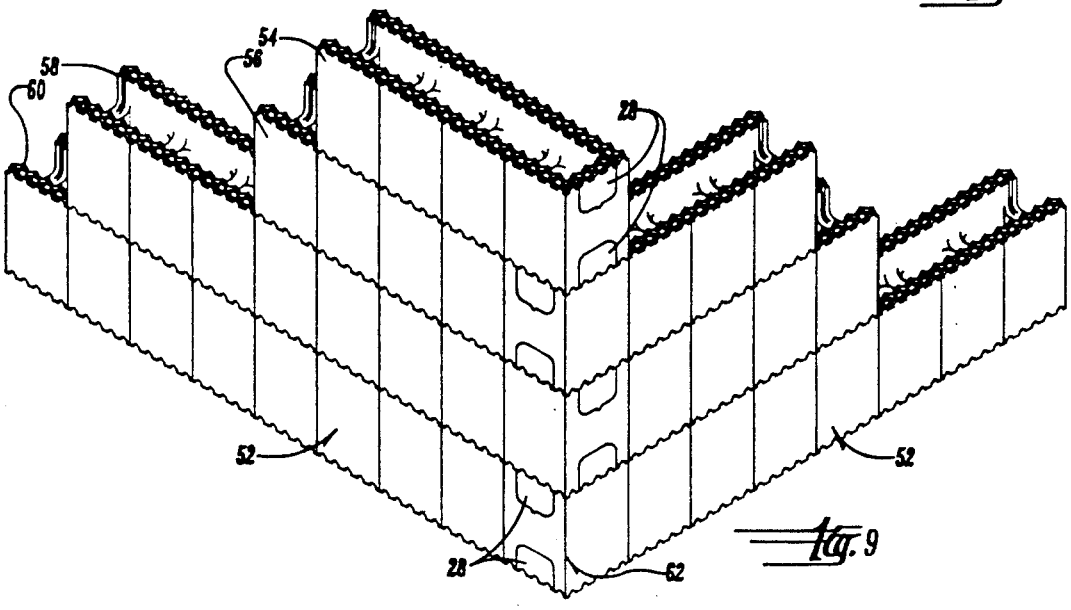
FIG. 9 is a perspective view of two intersecting concrete wall forms made in accordance with this invention and incorporating a plurality of the blocks of this invention.

FIG. 9 shows a plurality of the blocks 10 arranged in the intersection of two wall forms 52. Each wall 52 is comprised of courses of blocks 54, 56, 58 and 60. It is seen that the plugs 28 are inserted as described above at the corner 62 of the intersecting walls. It should also be noted that the individual blocks 10 in FIG. 9 are overlapped with respect to the blocks in the adjacent courses. The reinforcing rods 36 are positioned in the notches 34 as the walls 52 are being assembled from the individual blocks.

After the form of FIG. 9 has been created to create the complete wall form of a given height, plastic concrete (not shown) is poured into the hollow interior compartments 20 of the blocks through the uppermost course. The upper and lower interlocking surfaces 16 and 18 maintain the individual blocks 10 in rigid connection with each other to maintain the plastic concrete until the concrete hardens. The plastic blocks remain intact and can be used for insulation purposes. By using the score lines 32, electricians, for example, can dig away some of the plastic material and insert an electrical box in the cutout portion of the blocks 10. A conduit can be extended completely through the wall by inserting a hole in one of the spanner ribs 22. If desired, some utility lines can be inserted into the wall form before the concrete is poured.

The interlocking surfaces 16 and 18 present substantially more interlocking surfaces than existing blocks, and as a result, the blocks of this invention are much better able to serve their intended purpose than those of the prior art. It is therefore seen that this invention will achieve at least its stated objectives.

I claim:

1. A block means to be used with block means of similar character to create a form for a concrete wall, comprising, a block of substantially rectangular shape having opposite ends, opposite sides, an upper interlocking surface, a lower interlocking surface, a substantially hollow interior compartment, opposite end walls, and opposite side walls, said upper interlocking surface comprising an elongated longitudinal first rib on each of the upper surfaces of said side walls, and extending along the length of said side walls;

said ribs having a width less than that of side walls, a substantially horizontal ledge adjacent at least one side of each of said ribs, spaced apart laterally extending interlocking surface means comprising intersecting ribs extending completely across the upper surfaces of said side walls and intersecting said ledges and said first ribs, said lower interlocking surface comprising a mirror image of said upper interlocking surface, said first ribs and said intersecting ribs have an upper surface comprised of an inverted V-shaped, a plurality of cylindrical plugs extending upwardly at the intersection of said first ribs and said intersecting ribs.

2. The block means of claim 1 wherein said laterally extending interlocking surface means have a rectangular base portion.

3. The block means of claim 1 wherein a plurality of spanner ribs extend laterally across said interior compartment between said side walls, with each of said spanner ribs having a notch means to receive and support an elongated reinforcing rod.

4. The block means of claims 1, 2 or 3 wherein said block is comprised of a lightweight plastic material.

5. The block means of claim 1 wherein said plastic material is expanded polystyrene.

6. The block of claim 1 wherein one of said end walls have oppositely disposed upper and lower U-shaped openings and a central spanner rib portion in alignment with said spanner ribs.

7. The block of claim 6 wherein a U-shaped plug is locked into one of said U-shaped openings.

8. The block means of claim 1 wherein said block is stacked in interlocking relation with a plurality of other like blocks to form an elongated wall section, with said wall comprising a plurality of courses of blocks, with each course of blocks comprising a plurality of blocks laid in end to end relationship, and with the lower interlocking surfaces of the blocks in the upper adjacent course of blocks.

9. The block means of claim 8 wherein the blocks of each course of blocks longitudinally overlap at least two blocks in adjacent courses of blocks.

10. The block means of claims 8 or 9 wherein hardened concrete is located within the interior compartments of the blocks in each course of blocks.

11. The block means of claim 10 wherein elongated reinforcing rods extend longitudinally through each course of blocks.

12. The block means of claims 8, 9, 10 or 11 wherein the material of said block is lightweight plastic material.

* * * * *